United States Patent [19]

Haas et al.

[11] 4,254,357

[45] Mar. 3, 1981

[54] MULTI-ARRAYED MICRO-PATCH EMITTER WITH INTEGRAL CONTROL GRID

[75] Inventors: George A. Haas, Alexandria, Va.; Richard E. Thomas, Riverdale; Richard F. Greene, Bethesda, both of Md.

[73] Assignee: The United States of America as represented by the Secretary of the Navy, Washington, D.C.

[21] Appl. No.: 75,630

[22] Filed: Sep. 14, 1979

[51] Int. Cl.[3] ..... H01J 1/88; H01J 19/42

[52] U.S. Cl. ..... 313/268; 313/348; 313/107; 313/250; 313/302; 313/304; 29/25.1; 29/25.16

[58] Field of Search ..... 313/250, 268, 302, 304, 313/348, 309, 107, 346, 306; 29/25.1, 25.11, 25.16

[56] References Cited

U.S. PATENT DOCUMENTS

| | | | |
|---|---|---|---|
| 3,154,711 | 10/1964 | Beggs | 313/348 |
| 3,373,307 | 3/1968 | Zalm et al. | 313/346 |
| 3,638,062 | 1/1972 | Beggs | 313/348 |
| 3,694,260 | 9/1972 | Beggs | 313/268 |
| 3,967,150 | 6/1976 | Lien et al. | 313/304 |
| 4,096,406 | 6/1978 | Miram et al. | 313/348 |
| 4,165,473 | 8/1979 | Falce | 313/346 |

*Primary Examiner*—Saxfield Chatmon, Jr.
*Attorney, Agent, or Firm*—R. S. Sciascia; William T. Ellis; Melvin L. Crane

[57] ABSTRACT

A multi-arrayed electron emitter for microwave tubes in which the emitting surface is an array of continually replenished low-work-function regions, (micro-patches), whose boundaries include a control grid which is integral with the cathode surface and which controls emission from the low-work-function micro-patches. The continually replenished low-work-function regions are uniformly positioned relative to a matrix of uniformly spaced openings through which the low-work-function material is released.

9 Claims, 2 Drawing Figures

MULTI-ARRAYED MICRO-PATCH EMITTER WITH INTEGRAL CONTROL GRID

BACKGROUND OF THE INVENTION

This invention relates to an electron emitter for microwave tubes and more particularly to a micro-patch emitter with an integral control grid positioned on the cathode surface relative to equally spaced pores or openings through which low-work-function material effuses and migrates onto the cathode surface adjacent the grid structure.

Modern microwave tube designs are concentrating on applications involving ever-higher frequency and power requirements. Since the electron emission capabilities of cathode surfaces are limited, and the electron-beam interaction space becomes smaller with increasing frequencies, it is seen that the maximum convergence ratio (cathode area/beam area) which can be used strongly affects the limits of both the power and frequency of these designs. A main factor which restricts the convergence ratio is the beam spreading caused by excessive transverse electron velocities such as caused by grids which are used to control or modulate the electron beam. In order to minimize the effect of transverse velocities, as well as decrease the modulation voltage (which reduces modulator power and size requirements as well as increases fast switching and electrical turn-on performance), recent cathode designs have utilized grids which are in very close proximity, or actually are bonded directly to the cathode. However, in order to maintain good grid cut-off characteristics of the tube (as is required for example, during the time between pulses of "quiet" radars), it is necessary to maintain the non-emitting properties (i.e., high work-function) of the grid. Unfortunately, the close proximity of the grid to the hot cathode makes this task difficult because the grid is heated by the cathode to elevated electron emission temperatures and also because of the evaporation of the low-work-function material onto the grid from the cathode, which acts to lower the work function of the grid.

U.S. Pat. No. 4,096,406 sets forth a thermionic electron source with bonded grid control. This patent uses a barium aluminate porous tungsten cathode from which BaO effuses through pores in the tungsten. The grids are bonded to the cathode structure but during the bonding process the grid covers some of the pores so that some areas between the grids are free of BaO. This limits the operation of the device.

SUMMARY OF THE INVENTION

This invention makes use of a cathode structure in which the pores or openings in the cathode surface are placed in a specific arrangement so that the grid structure is equally spaced from each of the pores. In this arrangement, dispensers made from low-work-function material are strategically located in combination with equally strategically located boundaries which contain the spread of the low-work-function material. Further, the electron emission is controlled from the low-work-function areas. In this arrangement, the pores are placed in an orderly fashion and none of the pores are covered by the grid.

An object of the invention is to provide a control grid which is mounted on the cathode without covering any of the pores through which low-work-function material effuses.

Another object is to provide a grid-controlled electron source in which the control elements are mounted on insulating supports which are mounted on the cathode surface.

Yet another object is to provide a process of mounting a grid on a cathode surface without covering any pores.

DETAILED DESCRIPTION

Figure 1:
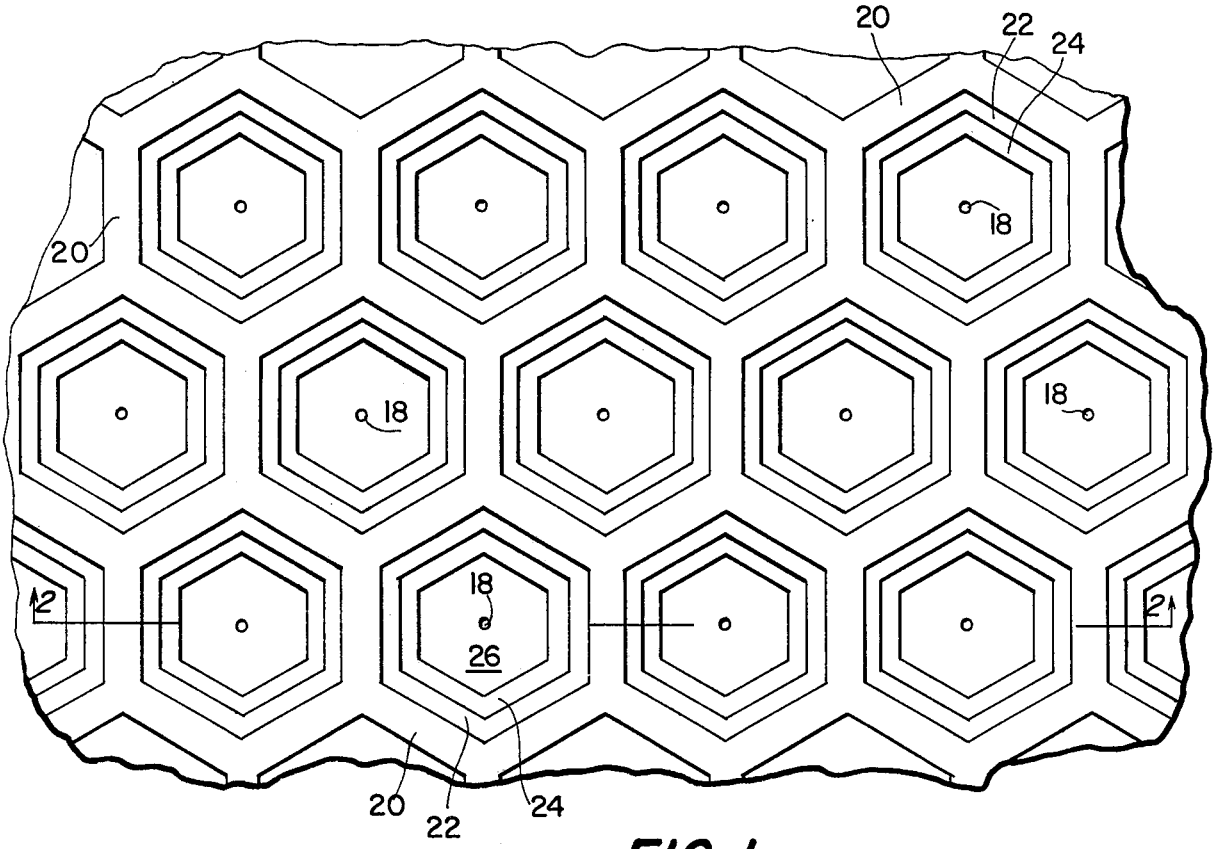
FIG. 1 is a partial top view of the invention illustrating the relationship of the cathode-grid structure are the pores or openings.
Figure 2:
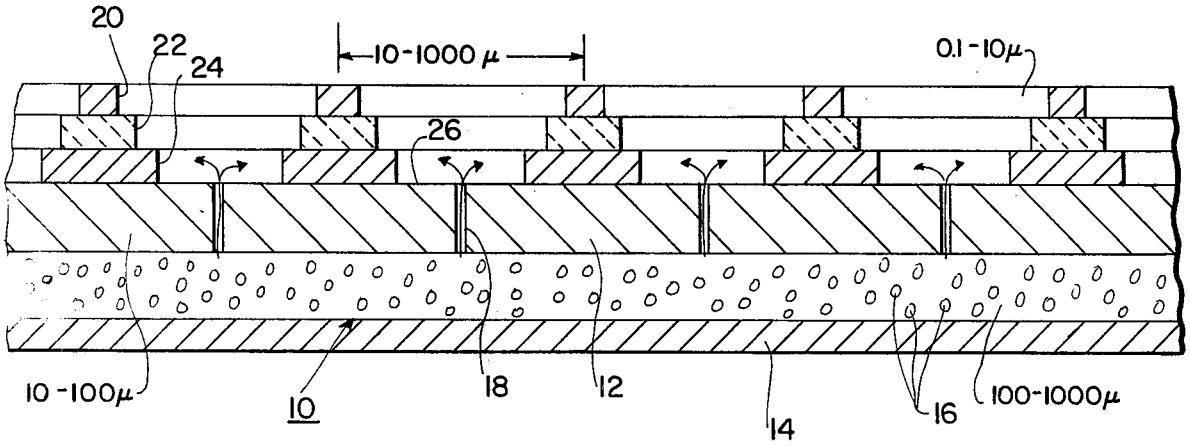
FIG. 2 is a partial cross-sectional view of the cathode-grid structure.

The drawing shows a thermionic cathode assembly 10 including a metal foil electron emissive material cathode 12, made of iridium or other suitable material having a thickness of from 10 to 100$\mu$. The cathode is suitably placed over a container 14 having a depth of from 100 to 1000$\mu$. The container 14 includes therein an active salt composition 16 such as barium oxide, BaO, which serves as a reservoir of BaO vapors which function to lower the work function of the electron emissive metal foil cathode. The metal foil cathode includes therein orderly placed pores or openings 18 each having a diameter of from 1–100$\mu$ through which the BaO vapors effuses and migrates onto the upper surface of the metal foil. The arrows in FIG. 2 illustrate direction not the flow path because the BaO vapors migrate along the surface of the metal foil electron emissive surface cathode. A control grid 20 made of zirconium, tantalum or other suitable material with a thickness from 0.1 to 10$\mu$ is mounted on and insulated from the cathode surface 12 by a high-temperature-type insulator 22 such as boron nitride, BN, having a thickness of from 0.1 to 10$\mu$. A barrier or isolator 24 may be used between the insulator and the cathode surface 26, which functions as an insolator to barium-compound migration. The barrier has a thickness of from 0.1 to 10$\mu$ and may be made of the same material as the grid or other suitable material so long as it is a material that will not poison the cathode and will prevent chemical interaction between the cathode and the other materials. The isolator, insulator and grid may be deposited onto the metal, foil cathode by a photolithographic process or any other method by which they will not separate due to the high temperature of operation. The pores in the foil are man-made by precise means such as photolithography and therefore are not random in form but placed in an orderly fashion in any desired array with any desired spacing; the isolator, insulator and grid structure are similarly uniformly placed about the pores.

Due to the heat during operation, the barium compound effuses from the pores and migrates onto the metal foil cathode surface 26. This provides a low-work-function surface, radially extending from each of the pores along the cathode surface. The diffusion length of the barium compound over the cathode surface 26 is governed by a balance between the migration and evaporation rate. The grid 20 is positioned at a distance less than the average diffusion length of the barium compound and the grid is of a material to which BaO will not adhere at elevated cathode temperatures. The grid surface has a high work-function which will not emit electrons. It has been determined that zirconium or tantalum is a good material for the grid structure. The barrier or isolator 24 prevents migration of the BaO onto the insulator 22 to prevent shorting of the grid. If the insulator is made of a material upon which the BaO will not adhere at elevated temperatures, the isolator will not be necessary. However, as a safeguard to insure that there is no shorting of the grid, the isolator should be used.

It is noted that the isolator, insulator and grid can be made in the shape of hexagons with the pores or openings equally spaced from each other and centrally located within the surrounding isolator, insulator and grid. Other shapes such as squares, rectanguler etc. can also be used. Since the pores are uniformly placed relative to the isolator-insulator-grid structure, BaO will be uniformly dispersed along the cathode surface as it effuses from the pores, thereby providing a uniform low-work-function surface.

In forming the cathode-grid structure, the cathode metal foil is secured to the edges of the container filled with a reservoir of barium compound. The pores may be formed in the metal foil structure either before or after being secured to the container. The pores are uniformly arranged in the metal foil so that the grid structure may be uniformly placed with respect to the pores. The isolator, if used, insulator and grid are formed by evaporating or sputtering deposition, or other well-known fabrication and control processes such as photolithography; scanning auger microprobe, SAM; thermionic emission microscope, THEM; scanning low-energy electron probe, SLEEP; or any other suitable method well known in the art.

The forming of a cathode-grid structure by the method of this invention forms a structure having an array of strategically located low-work-function material dispensers in combination with equally strategically located boundaries which controls the spread of the low-work-function materials and simultaneously controls electron emission from the low-work-function areas. The cathode-grid arrangement is easily fabricated, is rugged in design, has no thermal deformation, has no thermal lag and has a fast warm-up. Further, the structure permits higher operational frequencies, higher power output and has a fast switching and electrical turn-on capability because of higher gain. The grid bonded to the cathode maintains a high-work-function at all cathode assembly operating temperatures because the grid is at the same temperature as the cathode and the life times for barium products on zirconium become negligible at temperatures where appreciable barium is evaporated onto the grid from the cathode. At the operating temperatures, no barium sticks to the grid. One of the main reasons that the barium does not stick to the grid is because of the material from which the grid is made. If an isolator of the same material as that of the grid is used, the isolator functions to prevent barium compound migration.

During operation, as an electron emitter, the cathode assembly is heated to a temperature of from 600° to 1000° C. and the barium compound effuses from the pores and migrates onto the surface of the cathode. The barium compound coating provides a low-work-function surface which permits greater electron emission. The grid is insulated from the cathode and acquires substantially the same temperature as that of the cathode. The grid has a high-work-function and, thus, does not emit electrons and functions to control electron emission from the low-work-function areas. The operation of the electron emitter with integral control grid depends on the array of strategically located pores which dispense the low-work-function material in combination with equally strategically located boundaries which contain the spread of the low-work-function compound. The electron emission from the low-work-function areas is controlled by the placement of the pores, the grid, and the migration of the barium material on the surface of the electron emitter.

Other materials or combination of materials may be used; also, different shapes and sizes may be used for the metal foil, isolator, insulator, and grid. However, it is very important that the pores and other structures be strategically located relative to each other so that the electron emission will be uniformly distributed over the entire emission surfaces of the cathode.

The structure set forth herein places the control grid on and close to the cathode so the electron transit time between the cathode emissive surface and the grid is minimized.

The cathode structure may be used in any type tube but, more particularly, in high frequency and microwave tubes.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. An electron-emitter cathode assembly with an integral control grid which comprises:

a container for low-work-function material having a porous metal top serving as a cathode, the low-work-function material being dispensed from the pores to the cathode when the container is heated to provide an array of low-work-function electron-emitting areas centered at the pores; and an insulated grid disposed on the porous metal top of the container and having a plurality of openings, each opening being aligned with a single respective pore to control electron emission from the respective low-work-function electron-emitting area centered at the pore and to contain the spread of low-work-function material, the grid being made of a material to which the low-work-function material will not adhere at operating temperatures.

2. The electron-emitter cathode assembly with an integral control grid recited in claim 1 including:

an insulator disposed between the insulated grid and the porous metal top of the container.

3. The electron-emitter cathode assembly with an integral control grid recited in claim 1 wherein:

the top of the container is made of iridium.

4. The electron-emitter cathode assembly with an integral control grid recited in claim 1 wherein:

the grid is formed of zirconium.

5. The electron-emitter cathode assembly with an integral control grid recited in claim 1 wherein:

the grid is formed of tantalum.

6. The electron-emitter cathode assembly with an integral control grid recited in claim 1 wherein:

the grid insulator is formed of boron nitride.

7. The electron-emitter cathode assembly with an integral control grid recited in claim 2 wherein:

the isulator is made of the same material as that of the grid.

8. A method of forming an electron-emitter cathode assembly with an integral control grid comprising the steps of:

forming a container for low-work-function material;

providing a porous metal top for the container to serve as a cathode, the low-work-function-material being dispensed from the pores to the cathode when the container is heated to provide an array of low-work-function electron-emitters areas centered at the pores;

disposing on the porous top of the container an insulated grid having a plurality of openings, the grid being made of a material to which the low-work-function material will not adhere at operating temperatures;

aligning each opening with a single respective pore to control electron emission from the respective low-work-function electron-emitting area centered at the pore and to contain the spread of low-work-function material.

9. The method recited in claim 8 including the step of:

disposing an isolator between the insulated grid and the porous metal top of the container.

* * * * *

UNITED STATES PATENT OFFICE

CERTIFICATE OF CORRECTION

PATENT NO. : 4,254,357

DATED : March 3, 1981

INVENTOR(S) : George A. Haas, Richard E. Thomas & Richard F. Greene

It is certified that error appears in the above-identified patent and that said Letters Patent are hereby corrected as shown below:

In column 4, line 53, replace [insulator] with -- isolator --.

In column 5, line 1, replace [isulator] with -- isolator --.

Signed and Sealed this

*Eighteenth* Day of *May 1982*

[SEAL]

*Attest:*

GERALD J. MOSSINGHOFF

*Attesting Officer*

*Commissioner of Patents and Trademarks*